US009782639B2

(12) United States Patent
Kettler

(10) Patent No.: US 9,782,639 B2
(45) Date of Patent: Oct. 10, 2017

(54) TABLE TENNIS BALL STORAGE DEVICE

(71) Applicant: Kettler International Inc., Virginia Beach, VA (US)

(72) Inventor: Joachim Kettler, Ense (DE)

(73) Assignee: Kettler International, Inc., Virginia Beach, VA (US)

( * ) Notice: Subject to any disclaimer, the term of this patent is extended or adjusted under 35 U.S.C. 154(b) by 0 days.

(21) Appl. No.: 14/707,270

(22) Filed: May 8, 2015

(65) Prior Publication Data

US 2016/0016049 A1 Jan. 21, 2016

Related U.S. Application Data

(63) Continuation of application No. 29/512,364, filed on Dec. 18, 2014.

(30) Foreign Application Priority Data

Jul. 16, 2014 (EM) ..... I 002 503 425
Aug. 22, 2014 (DE) ..... 10 2014 112 046

(51) Int. Cl.
*A63B 47/00* (2006.01)
*A47B 25/00* (2006.01)
(Continued)

(52) U.S. Cl.
CPC ..... *A63B 47/002* (2013.01); *A47B 25/003* (2013.01); *A63B 67/04* (2013.01); *A63B 2102/16* (2015.10)

(58) Field of Classification Search
CPC ..... A63B 47/002; A63B 67/04
See application file for complete search history.

(56) References Cited

U.S. PATENT DOCUMENTS 2,569,007 A * 9/1951 Klyce ..... A47B 25/003 108/170
3,853,316 A 12/1974 Smith
(Continued)

FOREIGN PATENT DOCUMENTS

CN 203106213 U * 3/2013
CN 203106213 U 8/2013
(Continued)

OTHER PUBLICATIONS https://www.google.com/patents/CN203106213U?cl=en&dq=CN203106213&hl=en&sa=X&yed=0ahUKEwjerbXh7frLAhWEIB4KHflXDSYQ6AEIHDAA, Aug. 7 2013, Google Patents English Translation of CN 203106213 U.*

*Primary Examiner* — Gene Kim
*Assistant Examiner* — Jeffrey Vanderveen
(74) *Attorney, Agent, or Firm* — Pike IP Law, PLLC; Bernard G. Pike

(57) ABSTRACT

Table tennis ball storage devices provide a convenient place to store and retrieve table tennis balls during a game of table tennis. The ball storage device has an inner storage volume for receiving and retaining table tennis balls that is accessible from two openings, one designed to place table tennis balls into the storage volume and a second designed for removing table tennis balls. The first opening may be conveniently located on a playing end of a table tennis table and the second opening may be located on either the left or right side of the table tennis table. The first opening has a different shape than the second opening.

5 Claims, 4 Drawing Sheets

(51) Int. Cl.
*A63B 67/04* (2006.01)
*A63B 102/16* (2015.01)

(56) References Cited

U.S. PATENT DOCUMENTS

| | | | | | |
|---|---|---|---|---|---|
| 5,472,189 | A | | 12/1995 | Pfeiffer et al. | |
| 5,632,386 | A | | 5/1997 | Gabhart | |
| 5,810,681 | A | * | 9/1998 | Heim | A63B 47/02 221/199 |
| 5,820,499 | A | * | 10/1998 | Thomas | A63B 47/002 211/14 |
| 6,050,625 | A | | 4/2000 | Nisbet | |
| 8,414,431 | C1 | | 6/2014 | Chung et al. | |
| 2002/0047283 | A1 | * | 4/2002 | Campomane | A63B 47/02 294/19.2 |

FOREIGN PATENT DOCUMENTS

| | | | |
|---|---|---|---|
| DE | 3136170 | A1 | 3/1983 |
| FR | 2454820 | A1 | 11/1980 |
| FR | 2599263 | A1 | 12/1987 |

* cited by examiner

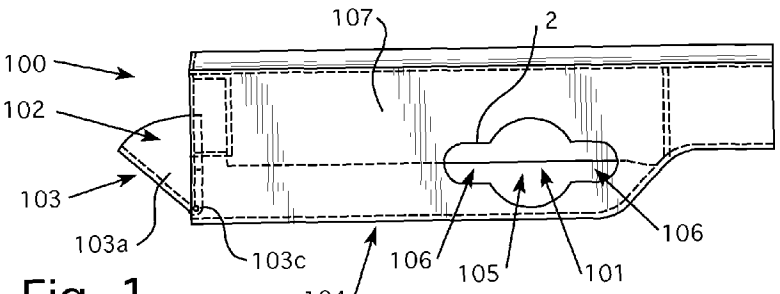
Fig. 1
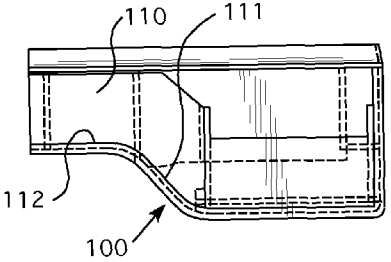
Fig. 2
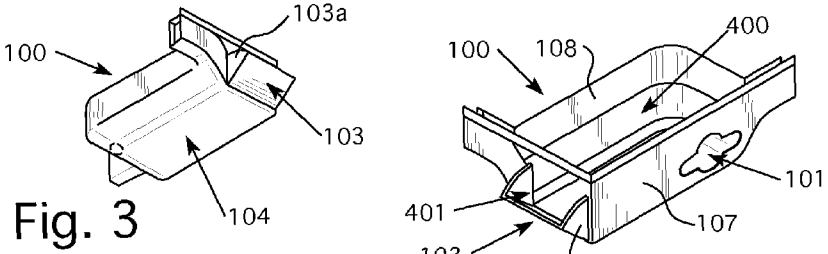
Fig. 3
Fig. 4
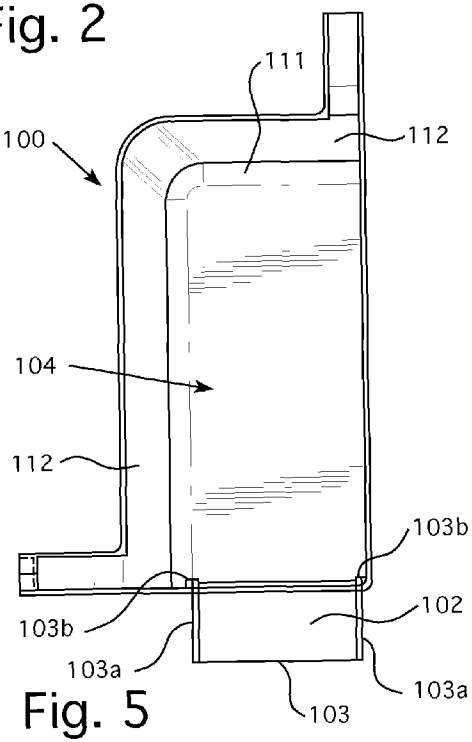
Fig. 5
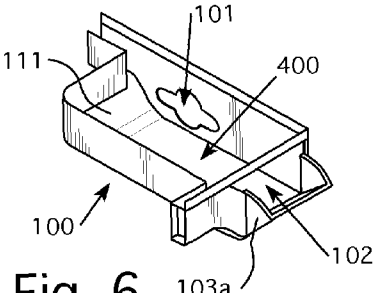
Fig. 6
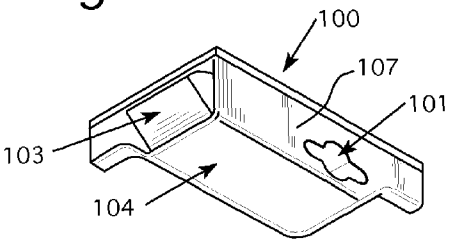
Fig. 7

TABLE TENNIS BALL STORAGE DEVICE

RELATED APPLICATIONS

This patent application claims priority under 35 U.S.C. §120 from U.S. patent Ser. No. 29/512,364 filed on Dec. 18, 2014 and under 35 U.S.C. §119 to German Patent Application No. DE 10 2014 112 046.9 and OHIM Design Registration No. 002503425-0001 filed on Jul. 16, 2014, all hereby incorporated by reference.

FIELD OF THE INVENTION

The invention is directed to ball storage devices. In one embodiment, a table tennis table comprises the ball storage device. The table tennis ball storage device includes a door for adding table tennis balls into the ball storage device and an opening defined by a side wall for removing table tennis balls from the ball storage device.

BACKGROUND

Certain table tennis ball storage devices are known in the prior art. Table tennis ball storage devices allow a table tennis player quick convenient access to a supply of table tennis balls. Typically, during a game of table tennis, the balls may regularly land on the floor or under a table after a point. The players must chase, find, and pick up the table tennis ball prior to starting the next point. This takes time away from actual game play.

To avoid this distraction and frequent interruption of play, a table tennis ball storage device may be conveniently located so that a supply of table tennis balls is available to the players to quickly start a new point. The errant table tennis balls may be collected later at a time convenient for the players to refill the ball storage device. Prior art table tennis ball storage devices are known. For example, U.S. Pat. No. 5,820,499 B is a tubular device for holding table tennis balls with an opening for insertion of table tennis balls and an opening to remove the balls. Tubular devices are also known from U.S. Pat. No. 5,810,681 B, U.S. Pat. No. 6,050,625 B, U.S. Pat. No. 3,853,316 B, German Patent Application No. DE 31 36 170 A1, French Patent Application Nos. FR 2454820 A and FR 2599263. For example, U.S. Pat. No. 2,569,007 discloses a device with only one opening for both adding and removing table tennis balls, which is arranged in a corner region of the table tennis table.

In the above devices, the balls are arranged next to each other in one dimension, substantially in one single row of balls. The dimensions of these prior art devices are such that the balls cannot be arranged in two dimensional pattern relative to each other, not even if the balls are offset relative to each other. Therefore, the prior art devices are required to be relatively long, to accommodate a sufficient number of balls for continuous play without the players having to regularly stop to pick up the errant table tennis balls. This prior art design has two openings for access to the storage volume of the ball storage device, one of which serves to fill the inner volume with table-tennis balls and the other for removal of the table tennis balls, and the two openings are inconveniently far apart. This is an inconvenient design because a user has to fill the ball one at a time and move to the other end of the ball storage device to remove a ball for play.

There is a need for a compact table tennis ball storage device that has a sufficient storage capacity for table tennis balls. There is a further need for a table tennis ball storage device in which the removal and the filling openings are more convenient than the prior art devices. There is a still further need for a table tennis table comprising at least one such table tennis ball storage device.

SUMMARY

In one embodiment, the ball storage device comprises an inner volume for receiving table tennis balls. The inner volume may be surrounded by and defined by at least one wall. The at least one wall may comprise a perimeter wall or a plurality of connected walls. The ball storage device comprises a first opening and a second opening defined by the at least one wall. Either the first opening or the second opening can be used to place table tennis balls into the inner volume and/or to take table tennis balls out from the inner volume. Each of the first opening and second opening may have different designs/shapes as desired. For example, the second opening may be specifically designed for easily adding table tennis balls to the ball storage device and the first opening may be specifically designed for easily removing table tennis balls from the ball storage device. In one embodiment, the second opening may comprise a door hingedly connected to the at least one wall that is capable of moving from a closed position that prevents table tennis balls from being added or removed through the second opening to an open position wherein balls may be added to the ball storage device.

In an embodiment of the ball storage device, the inner volume is arranged such that the table tennis balls can be arranged side by side in at least two dimensions and/or one above the other. The table tennis balls can be arranged offset relative to each other in side by side orientation and/or one ball stacked on top of another. In this configuration of the inner volume of the ball storage device, the length of the ball storage device can be shortened without reducing the number of balls that may be retained within the inner volume. Also in such a configuration, the distance between the first opening and the second opening may be shorter than a length of a ball storage device of similar capacity that retains table tennis balls in a single row. According to embodiments of the invention a table tennis ball can be passed through each of the two openings.

According to one embodiment of the invention, the first opening comprises at least one end portion and a central portion. In another embodiment, the first opening comprises two end portions and a central region. The central region of the first opening is sized to pass a table tennis ball through the central region into or out of the inner volume. A table tennis ball has a diameter of 40 mm, therefore, the central region is configured to allow an sphere with a diameter of 40 mm to pass through. The end portion or end portions (or in other embodiments, the bottom portion) are sized to allow human fingers or a finger or a thumb to pass through the end portions at the same time a table tennis ball is passed through the central region. The central region may be positioned between two end portions. With such an embodiment of a first opening, a user can grasp a table tennis ball inside the inner volume between their fingers (or a finger and a thumb) and remove the table tennis ball through the first opening. During removal of a table tennis ball from the inner volume, the table tennis ball is passed through the central region while the fingers or thumb of the user are passed through the end portions or a bottom portion. In this way, table tennis balls can be removed very easily and comfortably. In some embodiments, the table tennis balls are urged toward the first opening so that the balls may be conveniently grasped and removed from the first opening.

According to one embodiment of the invention, the central region may have a circular shape defined by a wall of the ball storage device. In this case, the central region is adapted for the circular cross-sectional shape of a table tennis ball and has a diameter of greater than 40 mm. In some embodiments, the central region is a circular shape with a diameter in the range of 41 mm to 60 mm.

According to an embodiment of the invention, the end portions may be arranged laterally adjacent to the central region when the ball storage device is attached to a table tennis table in its playing configuration. This arrangement allows for particularly easy removal of table tennis balls from the inner volume by a user. The average human finger is about 16 mm to 20 mm in diameter. The average human thumb is about 25 mm at its longest diameter. Therefore, the end portions have a height and/or width of greater than 25 mm to accommodate the digits of a left or right hand. In another embodiment, the end portions or a bottom portion may have a height and/or width in the range of 15 mm to 39 mm to accommodate the digits of a hand but prevent a table tennis ball from passing through the end portions. In more specific embodiments, the end portions or a bottom portion may have a height and/or width in the range of 25 mm to 35 mm.

According to a further embodiment of the present invention at least two table tennis balls next to each other and/or above one another can be can be passed through the second opening. Therefore in one embodiment, the second opening has at least one dimension greater than 80 mm (2 times the 40 mm diameter of a table tennis ball). The second opening may be formed, for example, as a filling opening, through which the interior can be filled with table tennis balls. Due to the fact that at least two table tennis balls can be passed through the second opening side by side and/or one above the other, the device can be filled quickly and efficiently with table tennis balls or table tennis balls may be easily poured from another container to the ball storage device. A user does not have to pass the table tennis balls through a relatively small opening, but can take advantage of the relatively large second opening. The term "side by side and/or one above the other" is understood here in particular that the table tennis balls aligned next to and/or above one another or stacked and can be guided through the second opening. In another embodiment, the second opening has a length greater than 80 mm and less than 180 mm to accommodate from up to four table tennis balls being added substantially simultaneously or together. In another embodiment, the second opening has a length greater than 40 mm and less than 100 mm and a height in the range of 40 mm to 100 mm. In a more specific embodiment, the second opening has a length greater than 60 mm and less than 85 mm and a height in the range of 50 mm to 70 mm.

According to one embodiment of the invention, the ball storage device may comprise a door that creates a filling region. The filling region may be located adjacent to the second opening and provides access for filling the inner volume with table tennis balls. In one embodiment, the filling region has a wall which is arranged at an angle between 10° and 80° with respect to the bottom surface of the inner volume. This filling region is particularly advantageous to easily fill table tennis balls into the interior of the inner volume, Due to the sloping of the wall, the table tennis balls are conveyed or urged by gravity into the inner volume when the device is attached to a table tennis table in the playing configuration. The filling region may also allow the balls to be poured from one container (a collection container, for example) into the ball storage device.

According to a still further embodiment of the invention, a wall defining the fill region can extend away from the inner volume from the at least one wall, such as the side wall or a playing end wall. This is particularly advantageous when the device is attached to a table tennis table. The wall of the ball storage device adjacent to the apron or side of the table tennis table can be, for example, flush with the table tennis table edge or apron. The door or wall of the filling region may then be on the outside of the edge or apron of the table tennis table, so that the device can be particularly easy to fill with table tennis balls. The door of the filling region may be hingedly connected to the at least one wall of the ball storage device such as the side wall, playing end wall, or the bottom floor. In the embodiment wherein the door is hingedly connected to the ball storage device, the filling region is accessible outside of the apron or edge of the table tennis table for filling the inner volume of the ball storage device with table tennis balls with the door in the open configuration.

The hinged door may be hingedly connected to the bottom surface or the side walls. The hinged door may be hingedly connected to the bottom surface by a hinge such as, but not limited to, a piano hinge or a set of hinges. The hinged door may alternatively hingedly connected to the side wall or bottom surface by opposing pins, wherein each pin in rotatably received within a recess. The pin or pins may be on the hinged door and the recesses on the side wall or bottom surface of the ball storage device. Alternatively, the pin or pins may be on the side wall or bottom surface and the recesses on the hinged door of the ball storage device. Further, in some embodiments, the hinged door may comprise side walls that define the filling region when the hinged door is in the open configuration. The side walls of the hinged door may further comprise stops that prevent the door from opening beyond the desired open position by contacting the wall of the ball storage device.

According to another embodiment of the invention, the bottom surface of the inner volume slopes from the second opening toward the first opening when the ball storage device is attached to a table-tennis table in the playing configuration. Thus, the table tennis balls are urged or conveyed by gravity to the first opening, where they can be removed by a player.

According to one embodiment of the invention, the first opening allows access from a first direction to the inner volume and the second opening access from a second direction to the inner volume. This is particularly advantageous if the device is mounted in a corner of a table tennis table. Thus, in such an embodiment, the first direction is substantially perpendicular to the second direction. The removal of the balls through the first opening can be carried out on a playing end of the table and filling of the ball storage device through the second opening can take place on either the left or right side of the table tennis table. Thus, the relatively small length of the device is particularly well suited to accommodate a particularly large quantity of table tennis balls at a convenient location at a corner of table tennis table.

In a further aspect, the invention relates to a table tennis table comprising a ball storage device in any of the embodiments described herein. A table tennis table, typically, comprises two playing surfaces, wherein each playing surface comprises a top surface, a bottom surface, a playing end surface, and left and right side surfaces. The table tennis table may further comprise a base for a table tennis table.

The playing surface of the table tennis table is supported on the base. The ball storage device can therefore be preferably located below the bottom surface of the playing surface so that the ball storage device does not interfere with the game play.

Each playing surface of the table tennis table can have four corners, left and right playing end corners and left and right net end corners. The two corners on the playing end of the playing surface are defined by the playing end of the table tennis table and either the left or right side of the table tennis table.

Other features and advantages of the present invention will become apparent from the following description of preferred embodiments with reference to the accompanying drawings. The same reference numbers are used for identical or similar components and for components with the same or similar functions.

Unless otherwise defined, all terms (including technical and scientific terms) used herein have the same meaning as commonly understood by one having ordinary skill in the art to which this invention belongs. It will be further understood that terms, such as those defined by commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of components, parts, techniques and steps are disclosed. Each of these has individual benefit and each can also be used in conjunction with one or more, or in some cases, all of the other disclosed embodiments and techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

BRIEF DESCRIPTION OF THE FIGURES

FIG. 1 is a schematic side view of an embodiment of the ball storage device from the playing end of the table tennis table;

FIG. 2 is a schematic side view of the embodiment of the ball storage device of FIG. 1 from the left side of the table tennis table;

FIG. 3 is a schematic perspective view obliquely from below the embodiment of the ball storage device of FIG. 1;

FIG. 4 is a schematic perspective view obliquely from above the embodiment of the ball storage device of FIG. 1;

FIG. 5 is a schematic plan view of the embodiment of the ball storage device of FIG. 1;

FIG. 6 is a schematic perspective view obliquely from above the embodiment of the ball storage device of FIG. 1;

FIG. 7 is a schematic perspective view obliquely from below the embodiment of the ball storage device of FIG. 1;

DESCRIPTION

Figure 9:
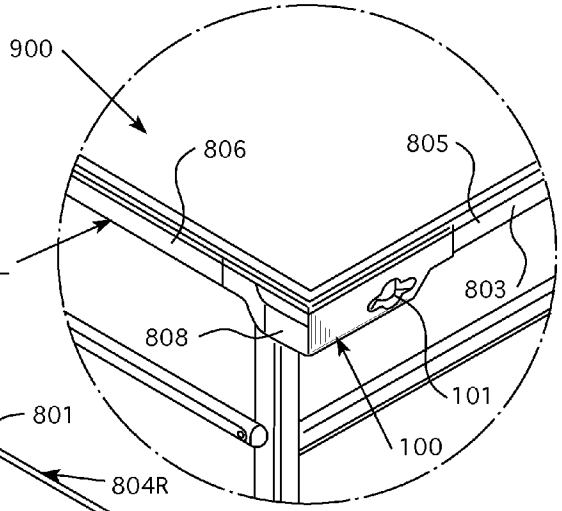
FIG. 9 is an exploded view of the ball storage device and the corner of the table tennis table defined by the left side and the playing end of the embodiment of the table tennis table of FIG. 8 labeled A.

Table tennis ball storage devices provide a convenient place to store and retrieve table tennis balls during a game of table tennis. Embodiments of ball storage devices comprise an inner volume for receiving and retaining table tennis balls. The inner volume may be defined by at least one wall of the ball storage device. In embodiments, the at least one wall defines a first opening and a second opening. The at least one wall may comprise a bottom floor, a playing end wall, and a side wall at least partially defining the inner volume, for example. The first opening may be located on a playing end of a table tennis table and the second opening may be located on either the left or right side of the table tennis table. A table tennis ball may be passed through either the first or second opening. However, in specific embodiments, the first opening is different than the second opening. One of the first opening and second opening may be designed for adding table tennis balls to the ball storage device and the other of the openings may be designed for removing a table tennis ball from the ball storage device.

In certain embodiments, the inner volume is adapted such that the table tennis balls may be arranged side by side in at least two dimensions and/or one above the other can be arranged. Therefore, the distance between a front wall and a back wall of the ball storage device may be at least 80 mm for a ball storage device designed to allow two table tennis balls to rest on the bottom surface or bottom surfaces of the ball storage device. Similarly, the distance between a front wall and a back wall of the ball storage device may be at least 120 mm for a ball storage device designed to allow three table tennis balls to rest on the bottom surface or bottom surfaces of the ball storage device.

In one embodiment of the ball storage device, the first opening is designed for both adding to and removing a table tennis ball from the ball storage device. In one such embodiment, the first opening has two end portions on either side of a central region. The central region is sized for receiving a table tennis ball either by adding or removing the table tennis ball from the ball storage device. For example, the central region may have a circular shape. The central region may be other shapes such as, but not limited to, oval, square, rectangular, pentagonal, other shape or combination of shapes.

The end portions of the first opening are adjacent to the central region and may be connected to the central region. The end portions may be horizontally disposed in relation to the central region if the device is attached to a table tennis table in the playing configuration. In such an embodiment, the playing end wall of the ball storage device may define a first opening comprising the two end portions connected to the central portion.

In an embodiment of the ball storage device, the second opening is defined by the side wall such that at least two table tennis balls next to each other may be passed through the second opening. The second opening in such an embodiment is therefore greater than 80 mm in width and 40 mm in height.

The ball storage device may further comprise a filling region adjacent to the second opening. The filling region may be a fixed shape or can be defined by a door capable of moving from an open position to a closed position. The filling region for the inner volume may comprise a wall that extends outwardly away from the walls surrounding the inner volume. In one embodiment, the wall defining a portion of the filling region may be at a fixed angle of between 10° and 80° with respect to a bottom surface of the inner volume, or the wall may be a door that may be moved to an open position wherein the door (hinged wall) is at an angle of between 10° and 80° with respect to a bottom surface of the inner volume. The wall may be hingedly attached to a side wall or the bottom surface of the ball storage device to form the door for opening or closing the second opening. As the door may be hingedly connected, the door comprises an open position allowing at least one table tennis ball to be placed in the ball storage device through the second opening and a closed position that prevents a table tennis ball from being placed in the ball storage device through the second opening. In some embodiments, the open position may allow at least two table tennis balls to be simultaneously placed in the ball storage device through the second opening. Typically, table tennis balls are added into the second opening and removed from the first opening at the player end of the table tennis table. It may be advantageous for embodiments of the ball storage device to have a bottom surface that slopes from an area adjacent to the second opening down to an area adjacent to the first opening. Therefore, a table tennis ball added through the second opening will tend to roll to an area accessible from the first opening to ease removal of the table tennis ball from the ball storage device for use. Additionally, the bottom floor may define a ramp and an upper ledge. Table tennis balls may be stored in two layers wherein the second layer of table tennis balls extends onto the ledge formed in the bottom floor. The table tennis balls on the ledge will roll down the ramp and toward the first opening as table tennis balls are removed from the ball storage device on a table in the playing configuration. The ledge may be sized to store one row of table tennis balls. An embodiment of a ball storage device that includes a ramp and ledge for storing table tennis balls can store more balls in the second layer of balls than in the first layer of table tennis balls.

In one embodiment, the ball storage device is located at one of the corners of the playing surface and further may be attached to the table tennis table below the bottom surface. Thus, the first opening may be accessible from the playing end of the table and the second opening may be accessible from either the left or right side of the table tennis table. For example, the first opening may be defined by the playing end wall, the second opening may be defined by the side wall, and the door is hingedly connected to one of the side wall and the bottom surface.

The table tennis ball storage device in certain embodiments may comprise at least one wall defining a table tennis ball storage volume, wherein the at least one side wall defines a first opening and a second opening.

EXAMPLE 1

Figure 8:
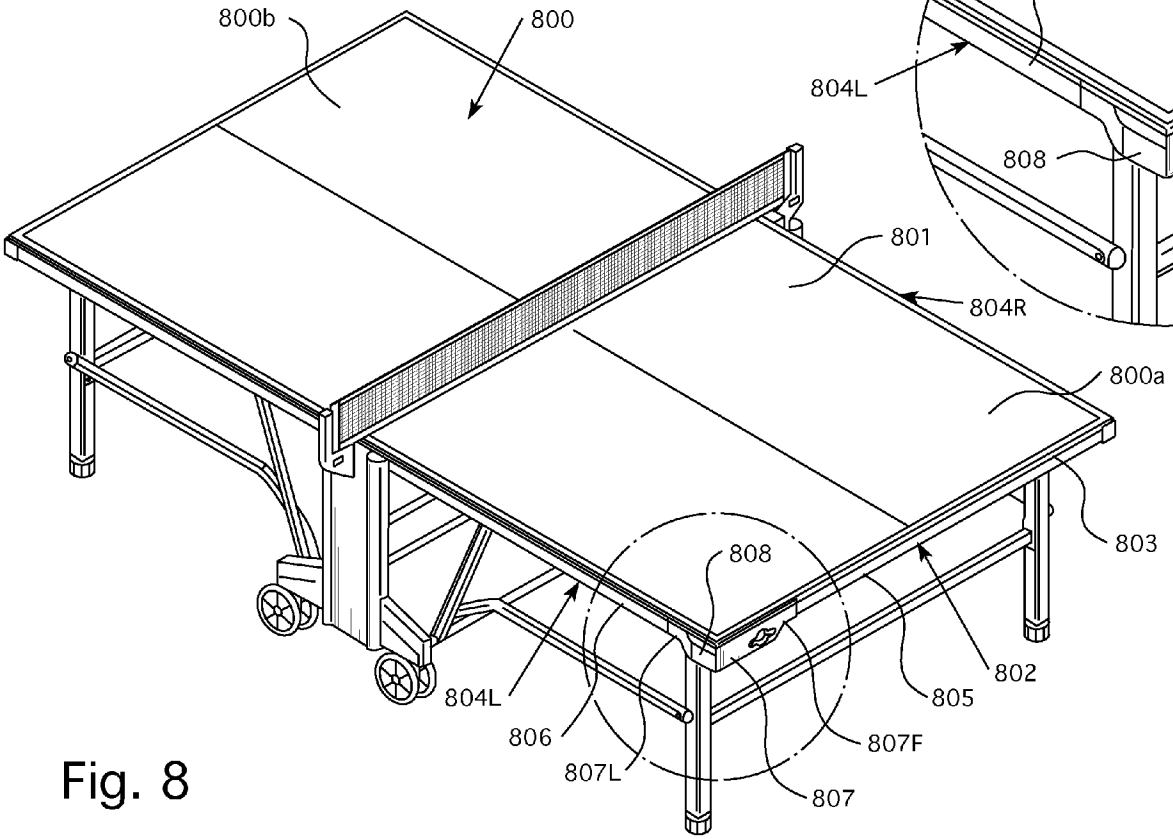
FIG. 8 is a schematic perspective view of a table tennis table in the playing configuration comprising an embodiment of the ball storage device at the left side corner of the playing end of the table tennis table.

An example of an embodiment of the ball storage device is shown in the figures. The ball storage device 100 comprises a first opening 101 and a second opening 401, Adjacent to the second opening 401 is a filling region 102. The filling region 102 is defined by inclined wall 103 and two side walls 103*a* on three sides with the second opening on a fourth side, so that a table tennis ball which is put into the filling region 102 is transferred by gravity into the inner volume 400 of the ball storage device when the table tennis table is in the playing configuration. A table tennis table 800 in the playing configuration is shown in FIGS. 8 and 9. The table tennis table 800 has two playing surfaces 800*a* and 800*b*.

The first opening 101 may be used for the removal of table tennis balls from the ball storage device 100. The first opening shown in FIG. 1 is defined by the playing end wall 107 having a center portion 105 located between two end portions 106. The end portions 106 are located adjacent to and connected to the central region 105 to form the first opening 101. In the ball storage device of FIG. 1, the center portion 105 has a circular shape. When taking a ball from the ball storage device, a user may insert two of his fingers into the end portions 106 to manipulate a table tennis ball from the inner volume 400 through the central portion 105 of the first opening 101. The playing end wall 107 extends below the central region 105 to for a lip to prevent table tennis balls from rolling out of the inner volume 400.

The inner volume 400 is bounded below by a bottom floor or bottom surface 104. The bottom floor has a slope to the first opening 101 from the second opening 401 and the back wall 108, so that the table tennis balls are moved by gravity toward the first opening 101 with the table tennis table in the playing configuration. Additionally, the bottom floor 104 may define a ramp 111 and an upper ledge 112, Table tennis balls may be stored in two layers and the second layer of table tennis balls may extend onto the ledge 112 formed in the bottom floor 104. The table tennis balls on the ledge 112 will roll down the ramp 111 and toward the first opening 101 as table tennis balls are removed from the ball storage device 100 on a table tennis table 800 in the playing configuration. The ledge 112 may be sized to store one or more rows of table tennis balls, typically the ledge will be designed to hold one additional row of table tennis balls.

The filling region 102 is adjacent to the second opening 401, the table tennis balls may be guided or poured through the filling region 102 through the second opening 401 and into the inner volume 400. In the embodiment of the ball storage device of FIG. 1, the inner volume 400 is large enough that at least two table tennis balls can be arranged side by side and/or one over the other in two dimensions as the balls pass through the second opening 401. The second opening 401 is sized such that at least two adjacent table tennis balls can pass through the second opening simultaneously.

The inclined wall 103 and two side walls 103*a* form a hinged door for opening and closing the second opening 401. The hinged door is shown in the open position in FIGS. 1 to 7, 10 and shown in the closed position in FIGS. 8 and 9. In the embodiment shown in FIG. 1, the hinged door comprises a pin 103*c*. The pin 103*c* is received within a recess 103*d* in the side wall of the ball storage device 100. The pin 103*c* is rotatably retained within the recess 103*d* such that the hinged door may be selectively moved from an open position to a closed position.

The hinged door may further comprise stops 103*b* on side walls 103*a*. The stops 103*b* contact the wall of the ball storage device 100 in the open position to prevent the hinged door from further opening and hold the inclined wall 103 at the desired angle in the open position.

FIG. 8 shows how an embodiment of the ball storage device 100 may be attached to a table tennis table 800 in the playing configuration. The table tennis table comprises two playing surfaces 800*a* and 800*b*. Each playing surface comprises a top surface 801, a bottom surface 802 (not shown), a playing end surface 803 at each playing end of the table tennis table, and left side surface 804L and right side surfaces 804R. The ball storage device 807 is located in a corner 900 of the table tennis table 800 below the playing surface 801. The ball storage device 807 is positioned with the front wall 807F of the ball storage device 807 substantially flush with the playing end 803 apron 805 and with the side wall 807L of the ball storage device 807 substantially flush with the left side 804L apron 807L. The apron of the table tennis table may be flush with the edge of the table tennis table surface or recessed under the edge. A hinged door 808 may be opened to provide a sloping wall forming a filling region (not shown in FIG. 8, shown in FIGS. 1 and 6 as 102) protrudes outward of the apron 804L, so that filling the ball storage device 807 with table tennis balls is particularly simple. At this position, it is also particularly easy for a used to reach the first opening 101 to remove table tennis balls from the device 807 for convenient play.

EXAMPLE 2

Figure 10:
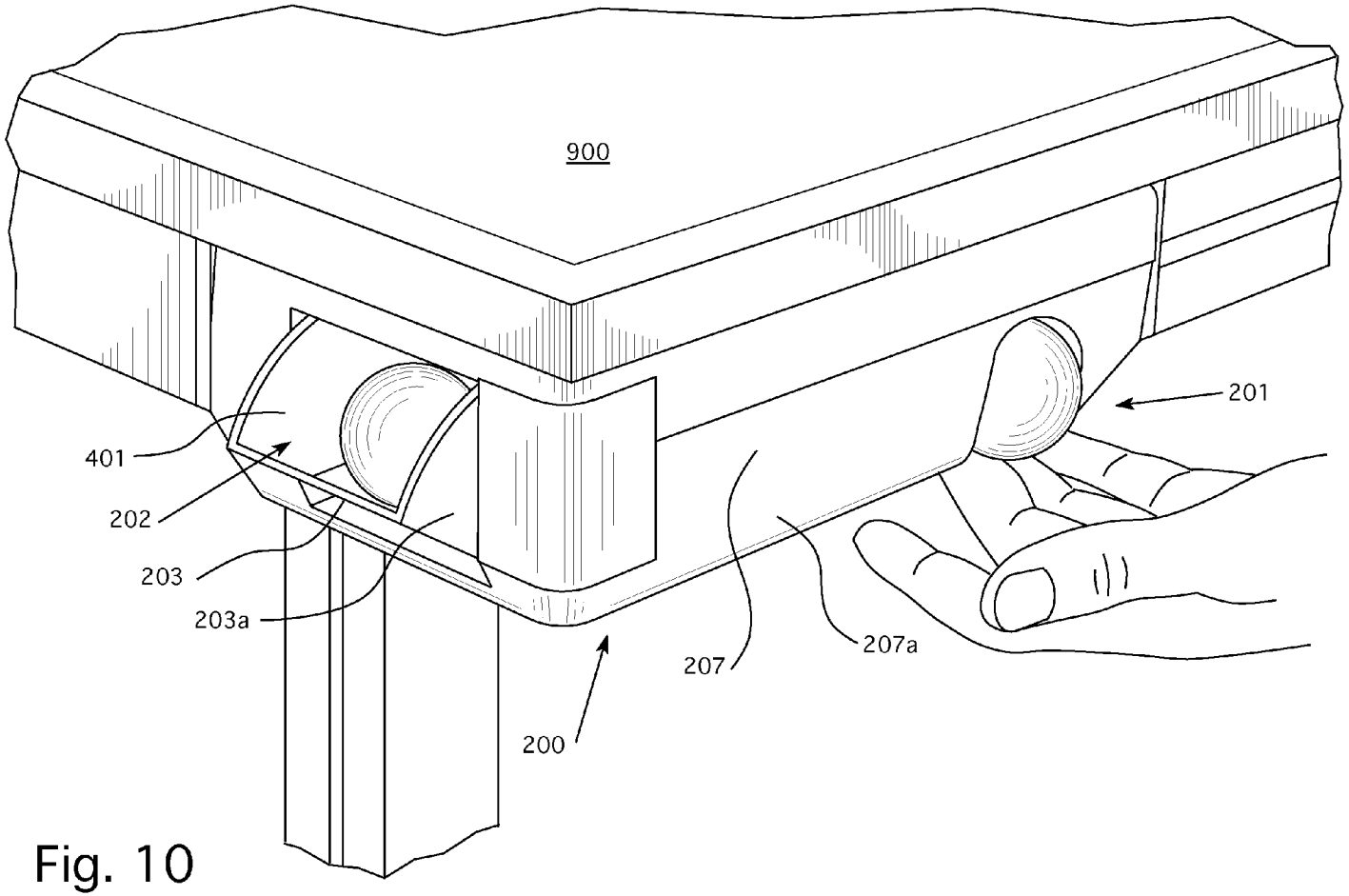
FIG. 10 is a schematic side view of another embodiment of the ball storage device from the playing end of the table tennis table.
Figure 11:
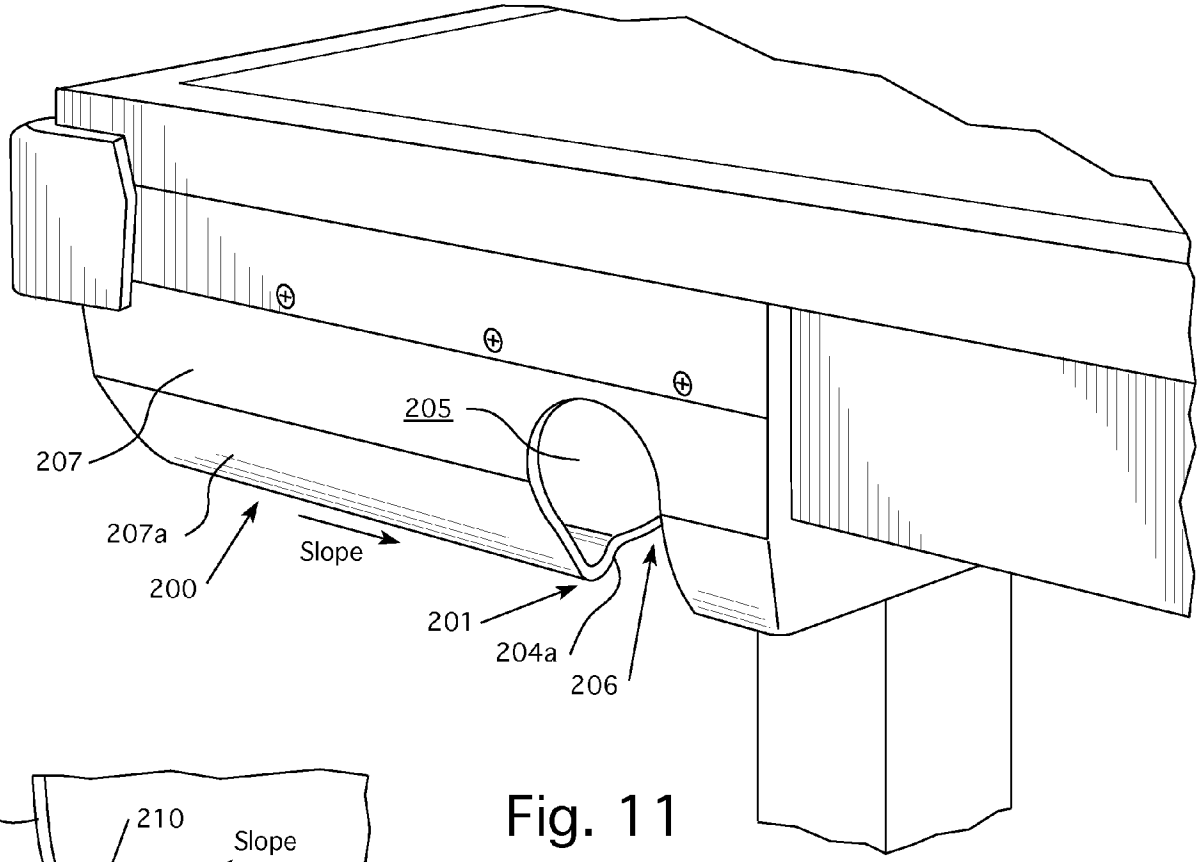
FIG. 11 is a schematic front view of the embodiment of the ball storage device shown in FIG. 10.
Figure 11A:
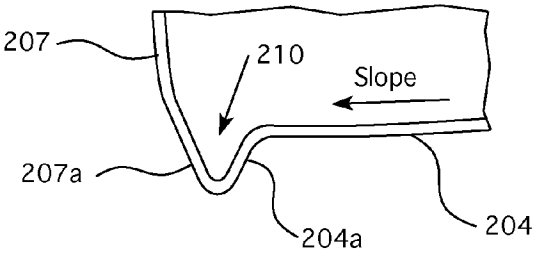

A second example of an embodiment of the ball storage device is shown in FIGS. 10 and 11. An embodiment of the ball storage device 200 is shown at the corner of a table tennis table 900 between a playing end and the left side of the table tennis playing surface. The ball storage device 200 comprises a first opening 201 and a second opening 401. Similar to the embodiment shown in FIGS. 1 to 8, adjacent to the second opening 401 is a filling region 202. The filling region 202 is defined by inclined wall 203 and two side walls 203*a* on three sides with the second opening 401 on a fourth side, so that a table tennis ball which is put into the filling region 202 is transferred by gravity into the inner volume 400 of the ball storage device when the table tennis table is in the playing configuration.

The first opening 201 may be used for the removal of table tennis balls from the ball storage device 200. The first opening shown in FIGS. 10 and 11 is defined by the playing end wall 207 having a center region 205 connected to a bottom portion 206. The bottom portion 206 is located below and connected to the central region 205 to form the first opening 201.

In the ball storage device of FIGS. 10 and 11, the center portion 205 has a circular shape. When taking a ball from the ball storage device, a user may insert a finger underneath a ball resting above bottom portion 206 to manipulate a table tennis ball from the inner volume 400 through the central portion 205 of the first opening 201. The playing end wall 207 extends into a playing end trough wall 207*a*. The playing end trough wall 207*a* is connected to the bottom surface trough wall 204*a* that extends up to the bottom surface 204. The trough 210 retains table tennis balls in the inner volume 400 in an area adjacent to the playing end wall 207 so that the table tennis balls are accessible through the first opening 201.

The inner volume 400 is bounded below by a bottom floor or bottom surface 204. In some embodiments, the bottom floor 204 and the trough 210 have a slope to the first opening 201 from the second opening 401, so that the table tennis balls are moved by gravity towards the first opening 201 of the ball storage device 200 connected to a the table tennis table in the playing configuration.

The filling region 202 is adjacent to the second opening 401, the table tennis balls may be guided or poured through the filling region 202 through the second opening 401 and into the inner volume 400. In the embodiment of the ball storage device of FIGS. 10 and 11, the inner volume 400 is large enough that at least two table tennis balls can be arranged side by side and/or one over the other in two dimensions as the balls pass through the second opening 401.

The embodiments of the described table tennis ball holder device and method are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined by the appended claims. Accordingly, the scope of the various embodiments of the present invention should not be limited to the above discussed embodiments, and should only be defined by the following claims and all equivalents.

The invention claimed is:

1. A table tennis table, comprising:

two playing surfaces, wherein each playing surface comprises:

a top surface;

a bottom surface;

a playing end surface; and left and right side surfaces;

a table tennis ball storage device attached under the bottom surface of at least one of the playing surfaces, wherein the table tennis ball storage device comprises:

an inner volume defined by a bottom floor, a playing end wall, a back wall opposite the playing end wall and a side wall connected to the playing end wall, wherein the bottom floor comprises a bottom surface extending from the bottom of the playing end wall, a ramp extending upward from the bottom surface away from the playing end wall, and an upper ledge extending from the top of the ramp to the back wall, wherein the inner volume is so dimensioned to store table tennis balls in two layers and the second layer of table tennis balls may extend onto the upper ledge such that the table tennis balls on the upper ledge will roll down the ramp and toward a first opening in the playing end wall and the upper ledge is dimensioned to store one or more rows of table tennis balls on the upper ledge;

the first opening defined by the playing end wall on the playing end surface; and a second opening defined by the side wall on the left or right side surface, and a door is hingedly connected to one of the side wall and the bottom surface, wherein the door has an open position allowing a table tennis ball to be placed in the ball storage device through the second opening and a closed position that prevents a table tennis ball from being placed in the ball storage device through the second opening, the door comprises a wall and two side walls that define a filling region adjacent to the second opening, wherein the door in the open position results in the wall at an upward angle of between 10° and 80° with respect to a bottom floor and wherein the slope of the wall the table tennis balls are urged by gravity into the inner volume, and the second opening has a length greater than 60 mm and less than 85 mm and a height in the range of 50 mm to 70 mm.

2. The table tennis table of claim 1, wherein the open position is dimensioned to allow two table tennis balls to be simultaneously placed in the ball storage device through the second opening.

3. The table tennis table of claim 2, wherein the device is sized such that may be the table tennis balls may be stored side by side and stacked on top of another tennis ball within the inner volume.

4. The table tennis table of claim 2, wherein the table tennis table comprises an apron on one of the left and right side surfaces and the side wall of the device is flush with the apron.

5. The table tennis table of claim 1, wherein the bottom floor slopes from the second opening toward the first opening when the ball storage device is attached to the table tennis table in the playing configuration.

* * * * *